United States Patent [19]

Shepherd et al.

[11] Patent Number: 4,697,291

[45] Date of Patent: Oct. 6, 1987

[54] CARPET DYEING APPARATUS AND METHOD

[76] Inventors: Richard C. Shepherd, 3108 Chatsworth Rd., Dalton, Ga. 30720; C. Robert Safarik, 15704 Gardenside La., Tampa, Fla. 33624

[21] Appl. No.: 4,741

[22] Filed: Jan. 7, 1987

Related U.S. Application Data

[63] Continuation of Ser. No. 719,501, Apr. 3, 1985, abandoned.

[51] Int. Cl.[4] ..... D06B 3/20; D06B 23/22

[52] U.S. Cl. ..... 8/151; 8/158; 55/95; 55/256; 68/15; 68/183; 261/124; 261/141

[58] Field of Search ..... 8/151, 158; 68/15, 183; 261/DIG. 26, 124, 141; 55/95, 256

[56] References Cited

U.S. PATENT DOCUMENTS

| | | | |
|---|---|---|---|
| 2,981,250 | 4/1961 | Stewart | 261/141 X |
| 3,047,418 | 7/1962 | Compton | 118/324 X |
| 3,289,439 | 12/1966 | Hall | 68/15 |
| 3,461,467 | 8/1969 | Duncan | 68/15 X |
| 3,835,909 | 9/1974 | Douglas et al. | 261/124 X |
| 3,914,962 | 10/1975 | Doire et al. | 68/183 X |
| 3,976,445 | 8/1976 | Douglas | 261/124 X |

*Primary Examiner*—Philip R. Coe

*Attorney, Agent, or Firm*—Kerkam, Stowell, Kondracki & Clarke

[57] ABSTRACT

A carpet dye beck is provided with submerged combustion heating apparatus for heating dye solution in the dye beck, by discharging pressurized high-temperature gas directly into the dye solution. The discharge of pressurized high-temperature gas directly into the dye solution provides bubbling of the gas through the solution, with turbulent agitation of the dye solution, and promotes high-efficiency, cost effective heating of a dye bath.

33 Claims, 4 Drawing Figures

CARPET DYEING APPARATUS AND METHOD

This is a continuation of application Ser. No. 719,501, filed Apr. 3, 1985, and now abandoned.

BACKGROUND OF THE INVENTION

1. Field of the Invention

This invention relates to textile dyeing apparatus, and method more particularly to dye becks used for dyeing carpets.

2. Description of Related Art

In a conventional commissioned carpet plant, a roll of carpet delivered to the plant for dyeing is unwound, twisted into a tow and looped over a power-driven reel disposed above the open top of a dye beck with the ends of the carpet being joined together to form and endless loop. A portion of the loop is submerged in the dye solution in the dye beck, and as the reel is driven, the carpet loop is continuously circulated through the dye solution. For effective dyeing, the dye solution needs to be heated to a temperature at round 200° F., but this temperature will vary depending on the type of yarn from which the carpet is made.

Conventionally, the dye solution in a dye beck is heated by sparging live steam generated by a boiler through the solution. This method of heating the solution, however, has certain disadvantages. For example, it entails the provision, in a carpet dyeing plant, of costly, large scale steam generation equipment. Boiler size limitations limit the number of dye becks which can be supplied with steam from a single boiler, so that in large plants it may be necessary to have multiple boilers or use a single boiler alternately to supply different banks of dye becks. Moreover, heating of the dye solution by the steam sparging method is itself somewhat slow and costly, particularly in the initial preparation of the fluid which requires considerable time and energy, and this presents another disadvantage to continuous dyeing by dye solution heated by condensed steam. Thus, it takes about 6,000 pounds of steam to raise the temperature of a typical dye solution at a rate of 3 degrees per minute. Typical boilers in a plant with twenty dye becks make about 50,000 pounds of steam per hour, and are coal oil or gas fired. Due to boiler limitations, most plants only make about 50,000 pounds of steam per hour, so that a maximum of only eight dye becks of a 4,000 gallon size can be heated to raise their temperatures 3 derees per minute.

Still another problem in sparging arrangements is that the carpet being dyed must be protected from live steam introduced into the dye solution. This is usually accomplished by use of a perforated divider wall disposed in the dye tank. While protecting, the carpet, the wall inhibits circulation which is necessary for efficient dyeing.

It is an object of the present invention to provide a novel method and apparatus for heating dye solution in a textile dye bath, particularly a carpet dye beck, which is more efficient and more cost-effective than the conventional steam sparging techniques.

Another object of the invention is the provision of a novel form of dye beck or like dyeing apparatus which has a self-contained dye solution heating system, so as to provide, in a plant employing a number of such dye becks, elimination of boilers and greater flexibility of usage than in conventional plants where plural dye becks are supplied with steam from multiple boilers or a large common boiler.

SUMMARY OF THE INVENTION

Broadly stated, the invention provides a method and apparatus for heating dye solution in a dye bath, such as a carpet dye beck, wherein high temperature combustion products are discharged directly into the dye solution in a manner whereby the combustion products are bubbled through the dye solution accompanied by heat exchange between the bubbled combustion products and the dye solution. More particularly, in accordance with the invention, pressurized, high temperature gas combustion products are generated by submerged combustion heating apparatus associated directly with the dye bath which directs a flame into a distribution manifold submerged in the dye solution.

A submerged combustion heater may, in accordance with the invention, be used to generate pressurized gas at about 2,000° F. which, when introduced directly to the dye bath, bubbles through the dye bath and transfers substantially all or a good bit of its heat to the dye solution, emerging from the surface of the dye bath at substantially ambient temperature or a slightly higher temperature. Further, the process is accompanied by significant agitation or turbulence of the heated dye solution within the tank which further enhances the dyeing process.

As applied to a conventional form of carpet dye beck, for example, heating apparatus in accordance with the invention may comprise a combustion chamber external to one wall of the dye beck, and a hot gas distribution manifold extending from the chamber through the dye beck wall substantially across the width of the dye beck adjacent the base thereof. The distribution manifold may have a longitudinal series of discharge orifices or slits. A conventional form of submerged combustion burner assembly may be located atop the combustion chamber, the arrangement being such that when the burner is idle, dye solution from the dye beck fills the manifold and the combustion chamber through the gas discharge orifices or slits. This fluid is displaced by pressurized products of combustion when the burner is operative, while the heated products of combustion issue from the discharge orifices and bubble through the dye solution in the dye beck. The configuration of the manifold and the discharge orifices, which may comprise a series of discrete openings or a single slit, or multiple lengthwise slits, is preferably such as to equalize the gas pressure across the width of the dye beck so as to provide substantially uniform bubbling of heated liquid through the dye solution across the width of the beck. The uniformity of heat distribution across the beck thus produced, promotes the possibility of dyeing carpet in an open-width configuration rather than in tow form.

In a preferred form of the invention, the combustion chamber may be surrounded by a heat transfer chamber, which may be air cooled, or which may communicate with the interior of the dye beck through a wall opening in the beck, so that the dye solution circulates through the heat transfer chamber in direct heat transfer relation with the combustion chamber. The walls of the combustion chamber may have fins to further enhance heat transfer to the dye solution.

The dye beck may include provisions for exhausting gasses rising through the solution so that further heat recovery and utilization of heated gasses may be realized.

Additional features of the invention will become apparent from the ensueing description and claims taken in conjunction with the accompanying drawings.

DESCRIPTION OF PREFERRED EMBODIMENTS

Figure 1:
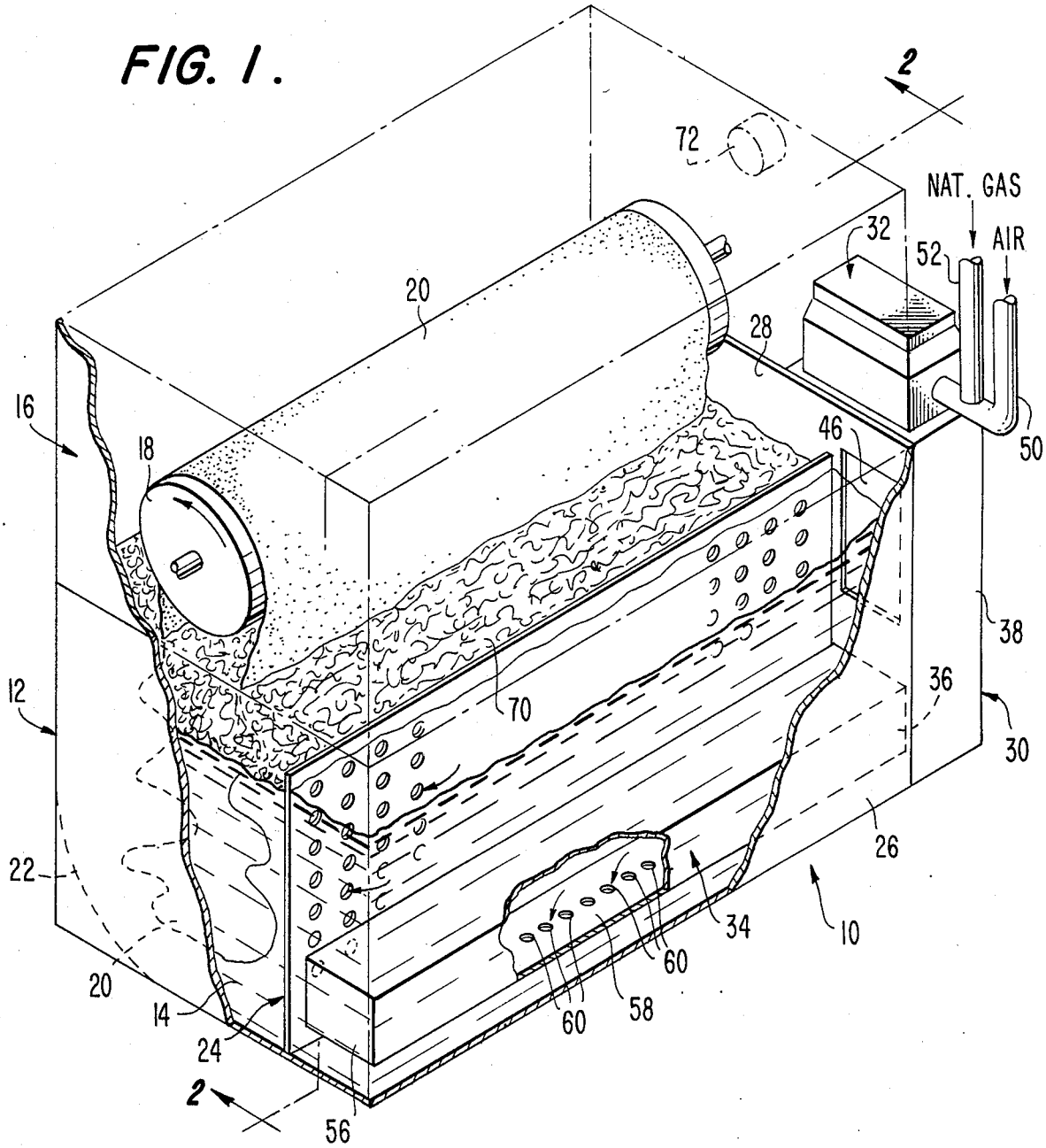
FIG. 1 is a perspective view, part broken away, of a carpet dye beck having a heating system in accordance with the invention.
Figure 2:
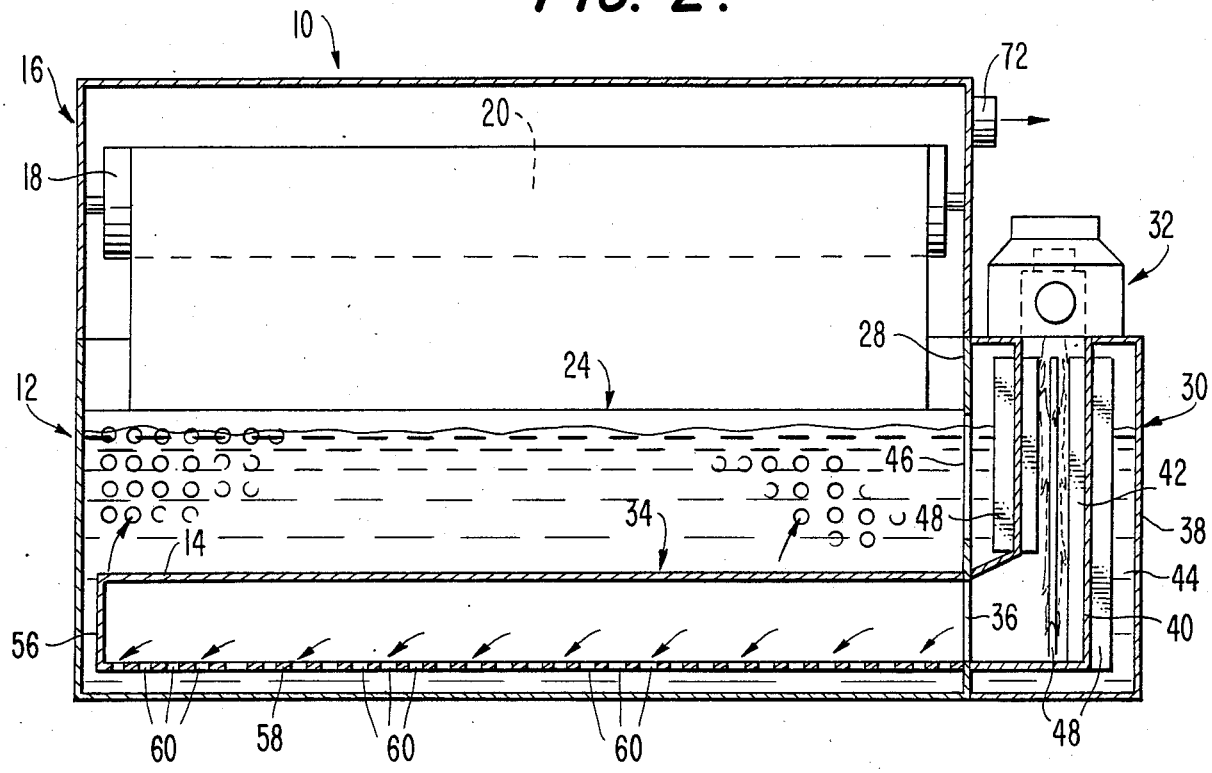
FIG. 2 is a sectional view on line 2—2 of FIG. 1.
Figure 3:
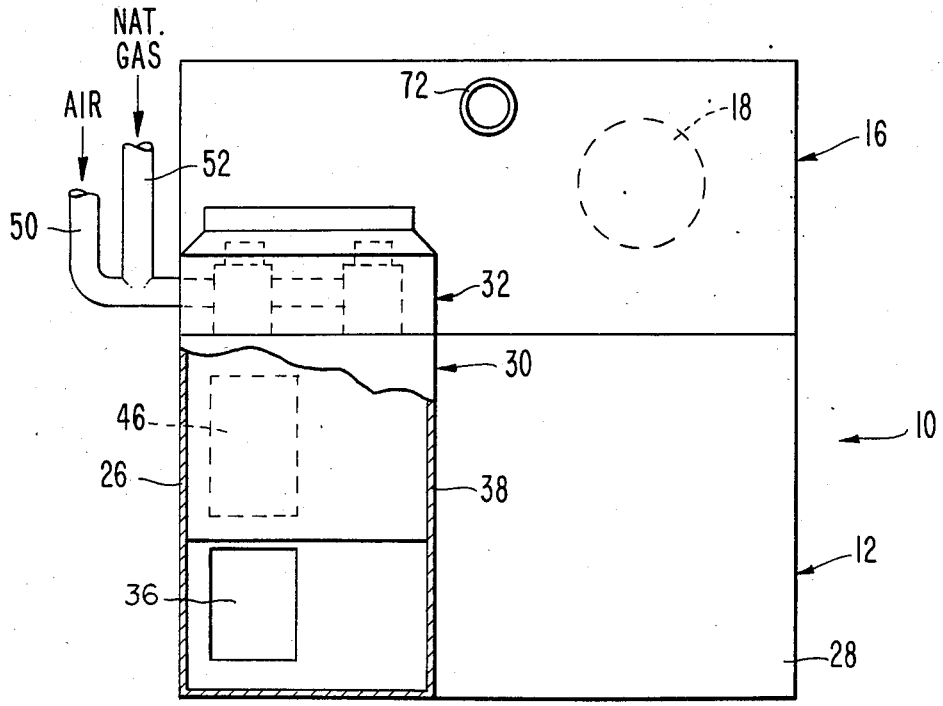
FIG. 3 is an end elevational view of the dye beck.

Referring initially to FIGS. 1-3, there is illustrated a carpet dye beck, generally indicated by reference 10, of the general type used in a commissioned carpet plant, but which is provided with a novel and improved heating system in accordance with the invention as described below.

Dye beck 10 has a tank portion 12 of generally conventional construction, for receipt of a dye solution 14. A cover portion 16 of the dye beck, which is also of generally conventional form, is provided, in known manner, with a driven main reel 18 for receipt of an endless carpet loop 20 to be dyed, whereby the carpet is continuously circulated through the dye solution by rotation of the reel. It may here be noted that carpet loop 20 is shown in FIGS. 1 and 2 as being spread substantially uniformly along the length of the reel 18, rather than being twisted into a tow, because the system for heating the dye solution, to be described, promotes uniform heat distribution through the dye solution lengthwise of reel 18, allowing for open-width dyeing of the carpet. It is understood, however, that the apparatus can, if required, be used with the carpet in twisted, tow-like configuration on reel 18. Tank portion 12 of the dye beck has a curved internal base wall 22 of conventional form, and may include an optional perforated distribution baffle 24 adjacent front wall 26 also in known manner.

In order to heat the dye solution up to temperatures necessary for effective dyeing of the carpet, for example up to about 190° F. for Nylon carpet, and about 210° F. for polyester carpet, a submerged combustion heating apparatus is used in association with the dye beck, effective to discharge hot pressurized gas directly into the dye solution, as will now be described in greater detail.

The submerged combustion heating apparatus includes a casing assembly 30 disposed on the outside of side wall 28 of tank portion 12 of the dye beck, a burner assembly 32 atop the casing 30, and elongate gas distribution manifold 34 extending from casing 30 into the dye beck through an opening 36 in wall 28. Casing assembly 30 has an exterior wall 38, which may be heat insulated, and an interior wall 40 which divide the assembly into an internal combustion chamber 42 and a surrounding heat transfer chamber 44. Distribution manifold 34 extends into the dye beck from the base of the combustion chamber. The heat transfer chamber 44 may, as shown in the drawings, be in direct communication with the interior of the dye beck through a further opening 46 in wall 28, so that the dye solution circulates through chamber 44 in direct heat transfer relation with walls 40 of the combustion chamber, so as to provide cooling of the combustion chamber and additional heating of the dye solution. The heat transfer effect may be enhanced by heat transfer fins 48 which may extend through on both sides of walls 40 as shown. In an alternative, non-illustrated embodiment, the heat transfer chamber 44 may be air cooled, and may be used to supply preheated air to burner assembly 32, in which case a suitable air transfer or air return passage means is provided for return of heated air to air inlet 50.

Burner assembly 32 may comprise a commercially available gas-fired submerged combustion burner unit, such as a unit of the type supplied by Hauck Manufacturing Co. of Lebanon, Pa., with gaskets and fittings adapting the unit to casing 30 and to suitable air and gas input pipes 50, 52 connected to a pressurized air source (for example from an air blower) and a source of gaseous fuel, and threaded connections for access parts permitting use of the unit against a back pressure of about 3 psig. A burner unit of this nature for example is designed so that the hydrostatic back pressure in the system will not cause variations in the air fuel ratio. Burner units of this nature are effective to heat the pressurized air up to temperatures of the order of 2,000° F.

Figure 4:
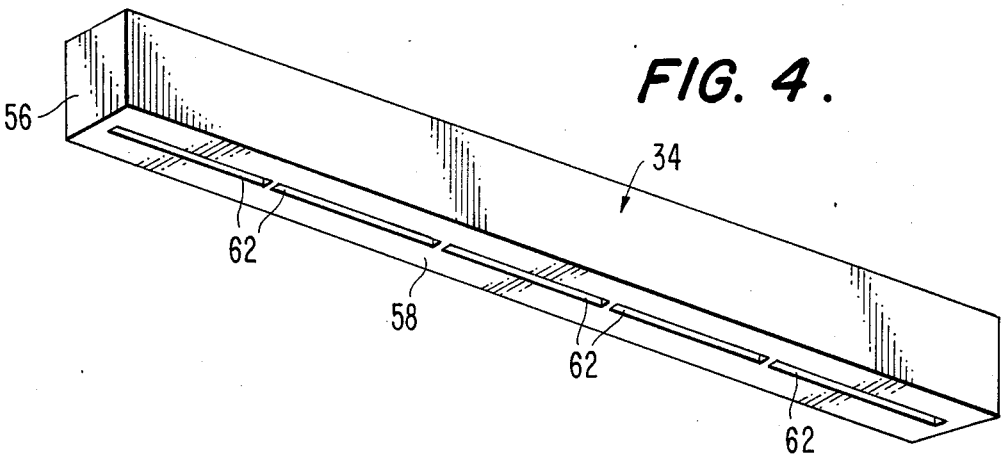
FIG. 4 is a perspective view of alternative form of gas distribution manifold for the heating system.

Distribution manifold 34 extends from the base of combustion chamber 42 along the full length of the dye beck adjacent front wall 26, somewhat above the base of the beck. The manifold is specifically designed to provide an even internal hydrostatic pressure across the width of the dye beck so that the heated gases are discharged into the dye beck with an even pressure distribution lengthwise of the manifold to effect bubbling of the heated gas through the dye solution and substantially evenly distributed heating across the width of the dye beck. To this end, base wall 58 may be provided with a series of gas discharge orifices 60 of like size, substantially evenly spaced along the length of the manifold. Alternatively, as shown in FIG. 4, the orifices 60 may be replaced by elongate discharge slits 62. A single discharge slit may also be used. In another non-illustrated embodiment, an even gas pressure distribution along the dye beck is obtained with a distribution manifold of constant cross section along its length, but having discharge orifices of varying size along the length of the manifold. The orifices may, for example, be arranged in successive series, with each series being of different diameter. Placing the discharge orifices 60 on the base wall 58 results in the gas being discharged into the lower portion of the dye beck, as seen in FIGS. 1 and 2, whereby substantially all of the dye solution will be circulated and heated.

When the burner is idle, prior to commencement of the heating process, dye solution will back-up through the discharge orifices 60 (or slits 62) and fill the manifold 34 and combustion chamber 42. On start up, an air nozzle of the burner unit is first operated on its own prior to ignition of the burner in order to displace the backed up dye solution, the burner gas nozzle is then opened, and the burner ignited in accordance with conventional submerged combustion practice. The submerged combustion burner unit produces a high energy flame. The products of combustion providing a heated gas typically at a temperature of about 2,000° F. which discharges into the dye solution through the base of discharge manifold 34 providing substantially uniform bubbling of the heated gas across the width of the dye beck, accompanied by turbulent agitation of the dye solution at all temperatures producing a churning level or foam layer. At the top the layer may be about 8 to 10 inches at the top of the dye solution at temperatures in the 100° F. to 170° F. range. A churning level or foam layer of about 12 to 14 inches may be provided at higher temperatures. The churning or foaming characteristic of the invention may be enhanced by including a foaming agent or foaming agents in the dye solution. While agitation of the dye solution may be considered beneficial to effective the dyeing, distribution baffle 24 is used optionally in applications where reduced agitation is desired, and has the additional effect of enhancing the lateral distribution of heat through the dye bath. The spent products of combustion which issue from the surface of the dye solution may, for example be exhausted from the dye beck through a vent opening 72.

Heating of the dye solution in accordance with the invention, by bubbling pressurized heated gas through the dye bath is found to be a remarkably efficient in terms of heat transfer from the heated gas to the dye solution. By passing the actual products of combustion through the dye bath, heat transfer from the gas to the liquid dye solution need not take place through a physical boundary. Rather, the intimacy of each gas bubble with the liquid lends a path of heat transfer which yields high efficiency. As a further aid to the efficiency of the process, minimizing escape of heat from the dye beck, the bath may optionally be provided with a floating surface layer 70 of insulating foam.

The high efficiency direct combustion-type heating of a dye bath in accordance with the invention, produces significant cost savings compared with conventional systems using, for example, sparged steam as the heat source, due to elimination of boilers and ducting for generation of steam. In retrafitted dye baths, however, existing steam installations may be used as supplementary heating means for dye baths heated in accordance with the invention or for other heating purposes.

While the invention has been described herein as applied to a dye beck for carpet dyeing in particular, it is not restricted to this application and may be used in other applications wherein dye solutions are to be heated and variations will be envisioned by those skilled in the art without departing from the spirit of the invention. Accordingly, reference should be made to the appended claims which are intended to provide a full measure of protection for all such variations which fall within the spirit and full scope of the invention.

What is claimed is:

1. A method of heating a dye solution in a dye bath for use in dyeing a textile article and the like placed in the dye solution comprising generating a pressurized high temperature stream of gas by burning fuel in a flow of pressurized air, and discharging the high temperature gas into the dye solution in a manner providing bubbling of the gas through the dye solution accompanied by heat transfer between the gas and the dye solution effective to heat the dye solution to a temperature effective for dyeing the article.

2. The invention of claim 1 wherein the heated gas is bubbled through the dye solution substantially uniformly across the dye bath and in a manner producing turbulent agitation in the dye solution.

3. The invention of claim 1, wherein the pressurized high temperature gas is generated in submerged combustion apparatus directly associated with the dye bath, and into the dye bath through discharge means extending lengthwise from said apparatus substantially across the entire width of the dye bath.

4. The invention of claim 3 wherein the dye bath comprises a carpet dye beck and the method includes continuously moving a carpet loop through the dye solution from a reel extending substantially parallel with the length of the discharge means.

5. The invention of claim 4 wherein the carpet is spread along the reel for open-width dyeing of the carpet.

6. The invention of claim 3 including insulating the dye solution against escape of heat by floating an insulating foam on the surface of the solution.

7. In a textile dyeing process wherein in a textile article is moved through a heated dye solution contained in a dye beck, the improvement comprising heating the dye solution to a temperature effective for dyeing the article by discharging heated gas generated by submerged combustion apparatus directly associated with the dye bath into the dye solution to provide bubbling of the heated gas through the dye solution substantially uniformly across the width of the dye beck.

8. The invention of claim 7 wherein the heated gas is discharged into the dye solution in a manner whereby the bubbling of the gas through the solution inducts turbulent agitation in the solution.

9. The invention of claim 7 including using the dye solution for cooling a combustion chamber of the submerged combustion apparatus by circulating the dye solution through a heat exchange chamber surrounding the combustion chamber.

10. The invention of claim 7 wherein the dyeing process comprises a carpet dyeing process.

11. Apparatus for dyeing textile articles and the like comprising container means defining a dye bath for containing dye solution, and heating means for the dye solution comprising means for generating a pressurized high temperature stream of gas by burning a fuel in a flow of pressurized air, and means for discharging the pressurized high temperature gas directly into the dye solution in a manner providing bubbling of the gas throughout the dye solution accompanied by heat transfer between the gas and the dye solution effective to heat the solution to a temperature effective for dyeing.

12. The invention of claim 11 wherein the heating means comprises submerged combustion heating apparatus having at least one combustion chamber defining the generating means and a gas discharge manifold defining the discharging means extending from the combustion chamber through the container means, the combustion chamber communicating with the dye bath through gas discharge orifice means in the discharge manifold.

13. The invention of claim 12 wherein the combustion chamber is located on either one or both sides of the container means and the discharge manifold extends from the combustion chamber substantially across the width of the container means, the discharge manifold and discharge orifice means being configured for substantially evenly distributing the pressure discharge of gas across the width of the container means.

14. The invention of claim 13 wherein the discharge manifold is of such cross section and internal geometry so as to maximize the distribution of heat along the length of the manifold.

15. The invention of claim 13 wherein the discharge manifold is of substantially constant cross section.

16. The invention of claim 12 wherein the combustion chamber is located externally of the container means and the discharge manifold extends into the container means through an opening in one wall of the container means.

17. The invention of claim 16 wherein the combustion chamber is incorporated in a casing structure which includes a heat transfer chamber surrounding the combustion chamber.

18. The invention of claim 17 including heat transfer means associated with a wall between the combustion chamber and the heat transfer chamber.

19. The invention of claim 17 wherein the heat transfer chamber communicates with the interior of the container means through a further opening in sid wall for circulating the dye solution through the heat transfer chamber.

20. The invention of claim 19 wherein the dye beck comprises a carpet dye beck and includes means for continuously circulating a carpet loop through the dye solution contained therein.

21. The invention of claim 11 wherein the container means comprises a carpet dye beck and includes means for circulating a loop of carpet through the dye bath.

22. A textile dye beck which includes submerged combustion apparatus for heating dye solution contained in the dye beck, the submerged combustion apparatus comprising a combustion chamber externally of the dye beck, means for connecting submerged combustion burner means atop the combustion chamber, and a distribution manifold extending from the base of the combustion chamber into the dye beck through an opening in one wall thereof, the distribution manifold including discharge orifice means for discharging products of combustion from the combustion chamber into dye solution contained in the dye beck when the burner means is operational, said discharge orifice means disposed to cause bubbling of said products throughout the dye solution to provide heat transfer therebetween.

23. The invention of claim 22 wherein the distribution manifold extends from said wall substantially across the width of the dye beck, and wherein the distribution manifold and discharge orifice means are mutually configured for promoting pressure equalization of gas discharge lengthwise of the manifold.

24. The invention of claim 23 wherein the distribution manifold extends adjacent the base of the dye beck along a further wall of the dye beck joined to said one wall.

25. The invention of claim 24 including a perforated distribution baffle for insertion into the dye beck to extend across the dye beck adjacent the distribution manifold.

26. The invention of claim 22 wherein the combustion chamber is located in a casing assembly which further includes a heat transfer chamber surrounding the combustion chamber, the heat transfer chamber communicating with the interior of the dye beck through a further opening in said one wall for circulating dye solution from the interior of the dye beck through the heat transfer chamber.

27. A method of heating a dye solution in a dye bath for use in dyeing a textile article placed in the solution comprising bubbling through the dye bath hot gases formed by igniting a mixture of gas and air delivered under pressure, discharging the combustion products of the mixture directly into the dye solution so as to bubble the combustion products through the dye solution in direct heat transfer relationship with the dye solution to thereby raise the temperature of the dye solution sufficiently to effect dyeing of the textile article.

28. Apparatus for dyeing textile articles and the like comprising container means defining a dye bath for containing a dye solution, and means for heating the dye solution comprising burner means for burning a mixture of air and gas, means for delivering said air and gas to the burner under pressure and means for discharging the burning mixture into the dye solution in a manner providing bubbling of combustion products of the mixture through the dye solution, said discharging means disposed to create high turbulence throughout the solution and direct heat transfer between the combustion products and the dye solution.

29. A method as set forth in claim 27, wherein the dye solution is covered with an insulatory foam.

30. A method as set forth in claim 27, wherein combustion products passing through the dye solution are recovered and exhausted for further heat recovery utilization.

31. In a textile dyeing process wherein a textile article is moved through a heated dye solution contained in a dye beck, the improvement comprising heating the dye solution to a temperature effective for dyeing the article by discharging heated gas generated by submerged combustion apparatus directly associated with the dye bath into a lower section of the dye beck and substantially across the width of the dye beck to provide bubbling of the heated gas throughout the dye solution effecting heat transfer between the gas and dye solution, said bubling also inducing circulation of the dye solution.

32. Apparatus for dyeing textile articles and the like comprisng a dye bath container means for containing a dye solution, a combustion heating means submerged within the container means, said heating means comprising a combustion chamber for burning a fuel in a flow of pressurized air to generate a pressurized high temperature stream of gas and a gas discharge manifold extending from the combustion chamber substantially across the width of the container means in a lower portion threof, said discharge manifold having discharge orifice means configured for directly discharging the gas into the lower portion of the container means and for substantially evenly distributing the gas across the width of the container means.

33. The invention of claim 32 wherein the discharge orifice means comprises a plurality of slits extending axially along a bottom wall of said discharge manifold, whereby the gas is discharged downwardly, said slits being configured so as to distribute said gas substantially evenly across the width of the container means, said downward discharge and said even distribution combining to create circulation of substantially the entire dye solution.

* * * * *